US007147724B2

(12) United States Patent
Klüpfel et al.

(10) Patent No.: US 7,147,724 B2
(45) Date of Patent: Dec. 12, 2006

(54) CLEANING DEVICE FOR A LONGITUDINAL CUTTING DEVICE AND METHOD FOR CLEANING THE DEVICE

(75) Inventors: Elmar Norbert Klüpfel, Kleinrinderfeld (DE); Burkard Otto Herbert, Würzburg (DE); Artur Wiesner, Urspringen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 541 days.

(21) Appl. No.: 10/467,333

(22) PCT Filed: Jan. 17, 2002

(86) PCT No.: PCT/DE02/00100

§ 371 (c)(1),
(2), (4) Date: Aug. 21, 2003

(87) PCT Pub. No.: WO02/066212

PCT Pub. Date: Aug. 29, 2002

(65) Prior Publication Data

US 2004/0064911 A1 Apr. 8, 2004

(30) Foreign Application Priority Data

Feb. 21, 2001 (DE) ..... 101 08 234

(51) Int. Cl.
*A47L 5/14* (2006.01)

(52) U.S. Cl. ..... 134/21; 15/309.1; 15/345

(58) Field of Classification Search ..... 15/306.1, 15/309.1, 345; 134/21, 16; 83/98, 99, 100
See application file for complete search history.

(56) References Cited

U.S. PATENT DOCUMENTS

| | | | | | |
|---|---|---|---|---|---|
| 1,746,431 | A | * | 2/1930 | Kolitsch | 15/309.1 |
| 1,806,458 | A | * | 5/1931 | Hayden | 83/98 |
| 2,234,153 | A | * | 3/1941 | George | 15/309.1 |
| 2,472,596 | A | * | 6/1949 | Kunz | 15/309.1 |
| 2,956,300 | A | * | 10/1960 | Bruno | 15/309.1 |
| 5,072,638 | A | | 12/1991 | Hüser | |
| 5,381,580 | A | * | 1/1995 | Kotitschke et al. | 15/309.1 |
| 6,135,267 | A | | 10/2000 | Straub | |

FOREIGN PATENT DOCUMENTS

| | | |
|---|---|---|
| CH | 613 881 | 10/1979 |
| DE | 631 858 | 6/1936 |
| DE | 2 164 554 | 6/1973 |
| DE | 37 30 631 A1 | 3/1989 |
| DE | 39 06 376 A1 | 9/1990 |
| DE | 44 25 666 A1 | 1/1996 |
| DE | 100 16 822 A1 | 10/2001 |
| EP | 0 183 863 A1 | 6/1986 |
| EP | 0 608 498 A1 | 8/1994 |
| EP | 0 671 247 A1 | 9/1995 |

(Continued)

*Primary Examiner*—Theresa T. Snider
(74) *Attorney, Agent, or Firm*—Jones, Tullar & Cooper, P.C.

(57) ABSTRACT

A longitudinal cutting device, that is usable for cutting a length of material such as a fabric or a paper web, includes a cylinder which supports the length of fabric or web. A blade cooperates with the cylinder to cut the fabric or web. A blower nozzle is used to direct a flow of fluid against the surface covering the cylinder. A suction nozzle is provided for suctioning the flow of fluid from the covering surface before it touches the length of fabric or the web.

14 Claims, 3 Drawing Sheets

FOREIGN PATENT DOCUMENTS

| | | | |
|---|---|---|---|
| EP | 0 916 416 | A2 | 5/1999 |
| GB | 909634 | | 10/1962 |
| JP | 06023697 | A | 2/1994 |
| JP | 07237185 | A | 9/1995 |
| JP | 10156796 | A | 6/1998 |
| WO | WO 89/04746 | | 6/1989 |
| WO | WO 96/07490 | | 3/1996 |
| WO | WO 00/42252 | | 7/2000 |

* cited by examiner

CLEANING DEVICE FOR A LONGITUDINAL CUTTING DEVICE AND METHOD FOR CLEANING THE DEVICE

FIELD OF THE INVENTION

The present invention is directed to a longitudinal cutting device for a web of material, and to a method for cleaning the longitudinal cutting device. The longitudinal cutting device utilizes a roller to support the web of material, and a blade that cooperates with the roller to cut the web.

BACKGROUND OF THE INVENTION

Longitudinal cutting devices are employed, for example, downstream of a rotary printing press in order to cut a web of material, and in particular a paper web which had been imprinted by the printing press. The web is cut longitudinally into a plurality of partial webs.

Particles, in the form of fine slivers, or dust, are released in the course of cutting the material web. A portion of these particles are removed from the longitudinal cutting device along with the web of material. However, another portion of these particles could adhere to the roller, where they can interfere with the further cutting process.

WO 96/07490 describes a process for the dust removal from a web of material with the aid of a high speed gas flow. It is assumed in this prior art document that efficient dust removal is only possible if a gas pressure of such a size is generated on the area from which dust is to be removed that the critical tension which is reversely proportional to the gas pressure is less than the electrostatic tension between the web of material and the particles stuck to it. This means that by generating a high pressure, the discharge of the particles, and therefore the cancellation of the electrostatic attraction, are promoted.

Although it is possible to clean a web of material prior to or after longitudinal cutting by the use of such a device, the device is not suitable for use in removing particles adhering to the roller of the cutting device itself. These particles then again pass through the contact zone with the cutting blade, which cutting blade may be, for example a circular cutting blade, with each revolution of the roller. The continued passage of these particles through the cutting zone can interfere with the cutting process.

JP 10-156706 AA shows a cutting device with a blower nozzle and a suction nozzle.

DE 631 858 C depicts a cutting device with a suction box and a scoop.

CH 613 881 A5 discloses a mechanism for dust removal. A blower nozzle is arranged in an inlet nip between a web and a roller. A suction nozzle is arranged at the end of the area of the roller on which the web or loop is formed.

DE 21 64 554 A shows a device for accomplishing the dust-free longitudinal cutting of running webs. A suction roller is provided underneath circular blades. The underpressure area is substantially limited to the area of the loop.

EP 0 183 863 A1 discloses a longitudinal cutting device in FIG. 7 with a blower nozzle on one side of the web. A suction nozzle, on the other side of the web, is assigned to this blower nozzle.

EP 0 608 498 A1 describes a device for cleaning a roller. A blower nozzle and a suction nozzle are arranged opposite the roller in the loop area of the web.

SUMMARY OF THE INVENTION

The object of the present invention is directed to providing a longitudinal cutting device for cutting a web of material into a plurality of partial webs, and to a method for cleaning such a longitudinal cutting device.

In accordance with the present invention, this object is attained by using a longitudinal cutting device that includes a roller which supports the web, and a blade that cooperates with the roller to cut the supported web. A blower nozzle and a suction nozzle are arranged in the area of a run-out gap between the cut web and the roller. The width of the suction nozzle is at least twice that of the blower nozzle. A tangential line at the surface of the roller, at the intersection of the roller surface with the main blowing direction of the blower nozzle, intersects a wall of the suction nozzle which is facing away from the blower nozzle.

The advantages to be obtained by the present invention consist, in particular, in that particles, in the form of fine slivers or dust, that are being released in the course of cutting the web of material and which are adhering to the surface of the roller of the longitudinal cutting device can be dependably removed before the surface of the roller again comes into contact with the web of material in the course of its rotation.

The cleaning device and its method of operation, in accordance with the present invention can be employed, in a particularly advantageous manner, in connection with a longitudinal cutting device whose roller has a groove which is working together with the circular blade. With such a longitudinal cutting device, a portion of the web of material is pushed into the groove in the roller during cutting. Particles which are released at the web's edge can become stuck in the groove, which particles, unless they are removed, can close the groove over a period of time.

In order to concentrate the cleaning effect of the blower nozzle on this critical area of the roller, the blower nozzle is preferably pointed into the groove.

The inside width of the blower nozzle, in the axial direction of the roller, preferably corresponds to between 0.2 and 2 times the width of the groove. In this way, the blower nozzle can produce a fluid stream which is exactly aimed on the groove, and whose cleaning effect thus essentially becomes active in this critical area of the roller.

The blower nozzle is preferably oriented in such a way that it generates a fluid stream on the surface of the revolving roller which fluid stream has a fluid stream direction that extends substantially opposite to the direction of rotation of the roller. With such an orientation of the blower nozzle, the effective flow speed of the fluid stream to which the particles in the groove are subjected is additively the sum of the web speed and thus the speed of the particles on the web, and the speed of the fluid stream.

To prevent the fluid stream from impinging on the web of material, a suction nozzle, which is aimed toward the surface of the roller is preferably provided. An inside width of the suction nozzle is preferably twice as large as the inside width of the blower nozzle. The suction nozzle can thus substantially completely suction off the fluid stream which is dispersed and spread on the surface of the roller by the blower nozzle.

In accordance with a first preferred embodiment of the present invention, the suction nozzle can be arranged upstream of the blower nozzle, in relation to the direction of rotation of the roller for suctioning off the fluid stream, which fluid stream is spread over the surface of the roller opposite to its direction of rotation. In an alternate configuration, the mouth of the blower nozzle is completely surrounded by the suction nozzle, so that the suction nozzle can catch the fluid stream from the blower nozzle independently of the direction in which the fluid stream is being spread over the surface of the roller.

To prevent the fluid stream, which is directed against the surface of the roller, from impinging on the web of material because of its straight propagation and to thus deflect it, it is preferably provided that the tangent line of the surface of the roller, at the intersection of this roller surface with the main direction of blowing of the blower nozzle, intersects with a wall of the suction nozzle, which wall is facing away from the blower nozzle.

The longitudinal cutting device can also be provided with a collection container for the particles which are aspirated by the suction nozzle. This makes it possible to exhaust the air, which is now freed of particles, directly in the same room in which the longitudinal cutting device operates.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
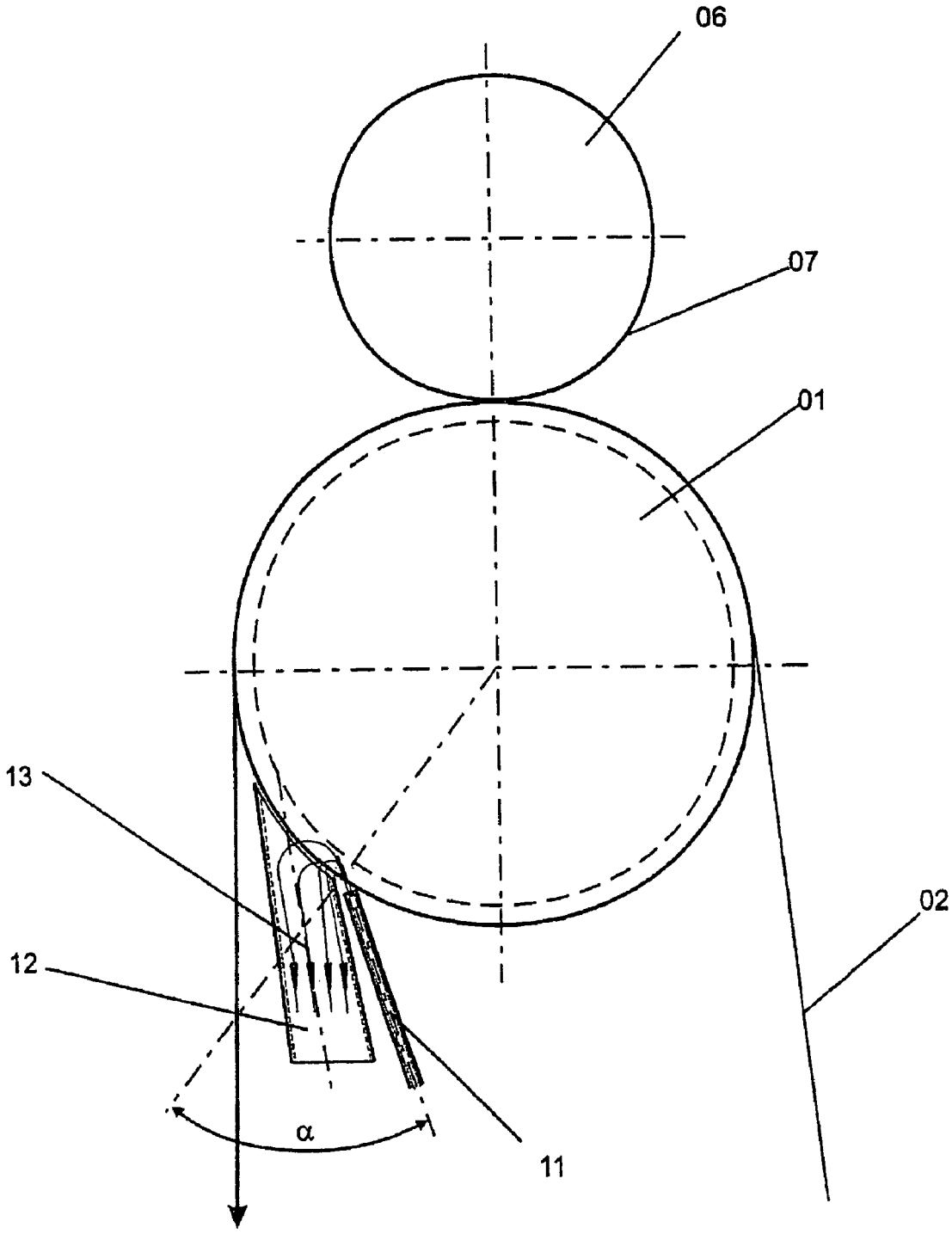
FIG. 1, a longitudinal cutting device, partly in cross-section, in accordance with the present invention, in FIG. 2, a side elevation view of the longitudinal cutting device, in FIG. 3, an enlarged detail from FIG. 1, and in FIG. 4, a section analogous to that in FIG. 3 through a longitudinal cutting device in accordance with a second preferred embodiment of the present invention.

The longitudinal cutting device in accordance with the present invention, which is shown in axial section in FIG. 1, comprises a substantially cylindrical roller 01 on which a tightly stretched web of material 02, in this case a paper web, is deflected over approximately 180°. The roller 01 is rotatably seated between two lateral side frames, which are not specifically shown in FIG. 1, and is rotatingly driven by any suitable roller drive, also not specifically shown, at a speed matched to the speed of passage of the web of material 02.

Figure 2:
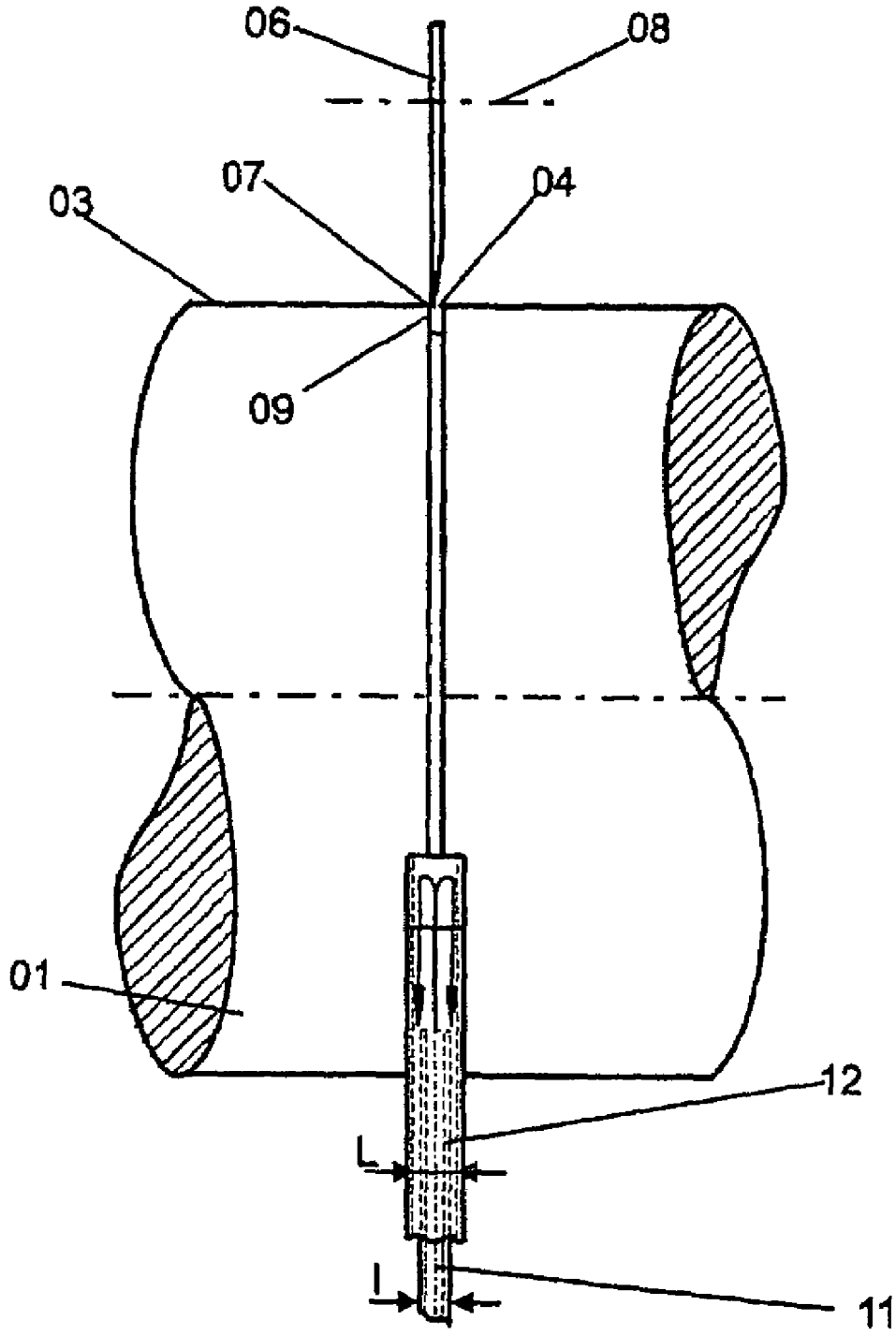

FIG. 2 represents a partial lateral or side elevation view of the longitudinal cutting device in accordance with the present invention, as shown in FIG. 1. A groove 04 is formed in the surface 03 of the roller 01, and into which groove 04 a cutting edge 07 of a blade 06, for example a circular blade 06, extends. The circular blade 06 is mounted on a shaft 08, which shaft 08 is only indicated in FIG. 2 by a dash-dotted line, and which shaft 08 extends parallel with the roller 01. The cutting edge 07 of the circular blade 06 has a planar face and a frusto-conical face. During the cutting process, the planar lateral face of the cutting edge 07 of the blade 06 lies at a distance of 0 to 0.1 mm from a lateral wall 09 of the groove 04, so that the web of material 02 is cut in the area of this lateral wall 09. Slivers of the web which are being created in the course of this cutting of the web of material 02, as well as the portion of the web of material 02 located above the groove 04 are pushed into the groove 04 by the circular blade 06. In the course of this web cutting, particles which are released during cutting of the web can become hung up in the groove 04 and can slowly block this groove 04 during extensive cutting operations. The result of this blockage is that the distance between, or contact between the planar face of the cutting edge 07 and the lateral wall 09 of the groove 04 is hindered. In a severe case, the circular blade 06 may even be pushed out of the groove 04.

Figure 4:
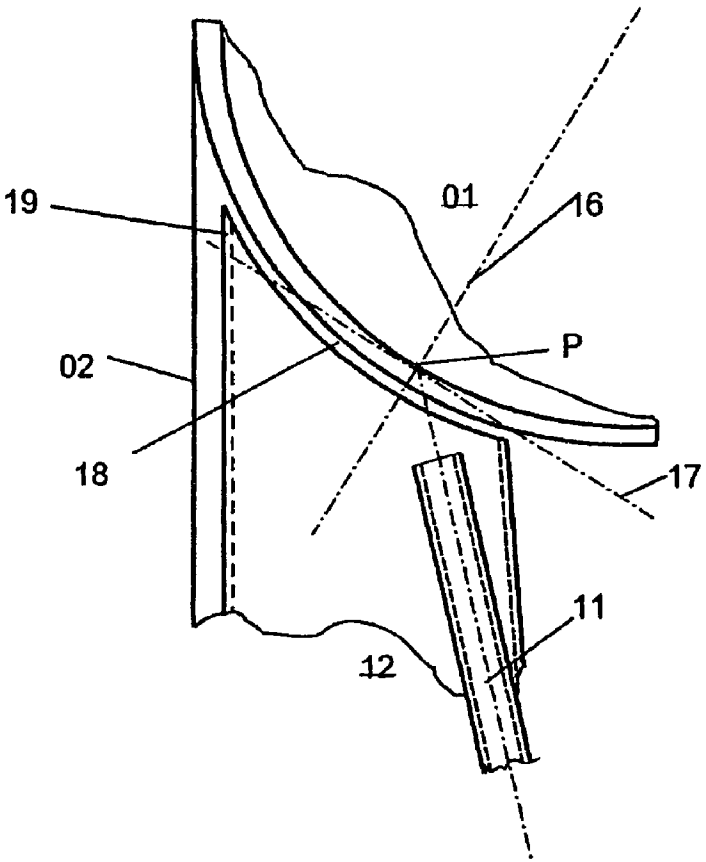
Figure 3:
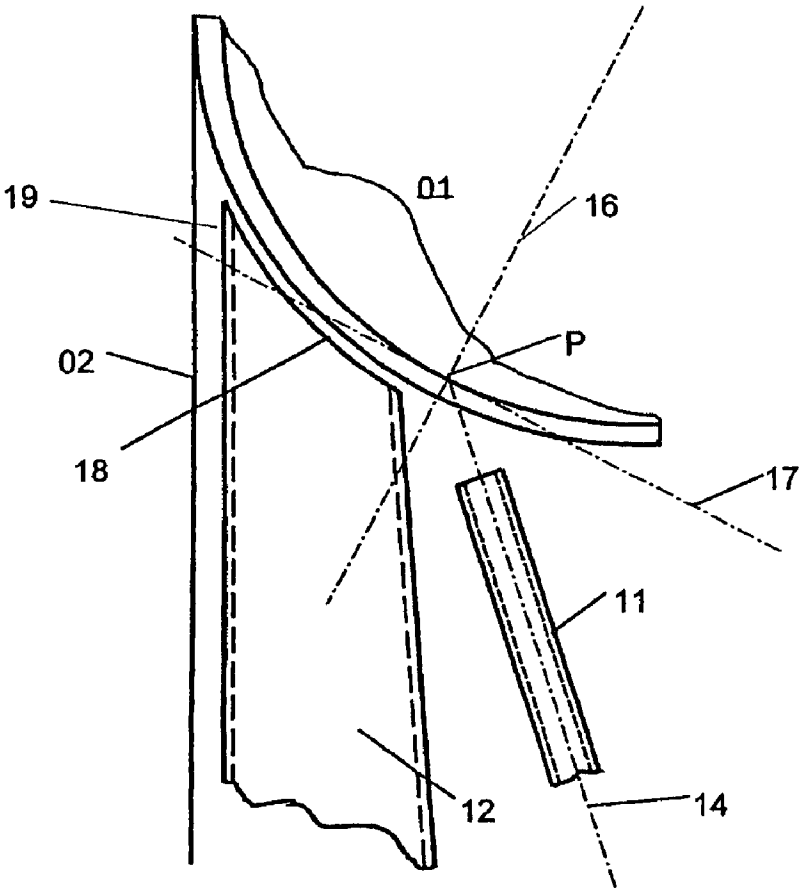

To avoid this, a cleaning device for the groove 04 is arranged vertically below the roller 01. This cleaning device, as seen in FIGS. 1–4, in accordance with the present invention includes a blower nozzle 11 and a suction nozzle 12. The blower nozzle 11, the suction nozzle 12 and the roller 01 are arranged on the same side of the web of material 02. The web of material 02, which has been cut by the cutting blade 06, forms a gap, typically called a run-out gap or run-out nip, together with the surface 03 of the roller 01 downstream of the roller 01 when viewed in the conveying direction of the web of material 02, as seen most clearly in FIG. 1. The blower nozzle 11 and the suction nozzle 12 are both arranged in this run-out gap. The longitudinal axes of both nozzles 11, 12 extend in a plane defined by the groove 04 of the roller 01. In the plan view of FIG. 2 the suction nozzle 12 is illustrated in a transparent manner in order to be able to also show the blower nozzle 11. The blower nozzle 11 is aimed in such a way, as seen in FIGS. 3 and 4 that it directs a fluid stream, preferably a stream of compressed air, against the roller surface 03 at an angle $\alpha$ of between 30 and 65° with respect to a normal surface line, as shown in FIG. 1. It is achieved, by this selection of the angle $\alpha$, that the blown air stream from blower nozzle 11 is propagated on the roller surface 03 substantially opposite to the direction of movement of the roller surface 03, so that particles adhering to the roller 01 are subjected to a fluid flow speed which is increased by the speed of rotation of the roller 01. Because the blown air stream from the blower nozzle 11 is oriented against the roller surface 03, rather than being tangential with respect to it, a back pressure is formed at the point of impingement of the blown air stream, which itself in turn causes locally increased flow speeds. The blower nozzle 11 is operated at an overpressure of approximately 0.4 bar.

A suction pump, which is not specifically represented in the drawing figures, and which provides the vacuum or underpressure necessary for operation, is connected to the suction nozzle 12. Furthermore, a collection container for particles carried along by the suction air stream, for example a filter bag or a collection chamber of an electro-static or a cyclone precipitator, is arranged in an underpressure line connecting the suction nozzle 12 and the suction pump, or is connected downstream of the suction pump. In this way, the filtered suction air stream can be directly discharged in the vicinity of the longitudinal cutting device.

As can be seen in FIG. 2, an inside width I of the blower nozzle 11, which is embodied in a tube shape in FIGS. 1–4, is substantially larger than an inside width of the groove 04. The blower air stream issuing from the mouth of the blower nozzle 11 at a distance of a few millimeters from the groove 04 enters the groove 04 for the most part and is thus guided in groove 04 without substantial portions of the blown air stream being distributed or spreading out in the axial direction of the roller 01 on both sides of the groove 04 on the surface 03.

As can be seen most clearly in FIG. 1, and in which the arrows 13 represent the course of the blown air stream, the suction nozzle 12 is used for aspirating this blown air stream off the roller 01 before it impinges on the cut web of material 02. Uncontrolled beating or flapping movements of the web of material 02 are prevented in this way. The clear, unobstructed cross section of the suction nozzle 12 is substantially greater than that of the blower nozzle 11.

As FIG. 2 shows, an inside width L of the suction nozzle 12 is more than twice as large as the inside width I of the blower nozzle 11. This size ratio is selected in order to insure that even those portions of the blown air stream which may have been scattered in the axial direction on the surface 03 are substantially aspirated off the surface 03 and do not cause fluttering or flapping movements of the cut web of material 02. The suction nozzle 12 is operated at an under-pressure or vacuum of approximately 0.25 bar.

FIG. 3 shows a first preferred arrangement of the blower nozzle 12 at the roller 01 in cross-section and of a scale which is enlarged in comparison with FIG. 1. The main blowing direction of the blower nozzle 11 which, in the case of a cylindrical blower nozzle 11, corresponds to its longitudinal axis 14, intersects the surface 03 of the roller 01 at an impact point P. The angle $\alpha$ of the longitudinal axis 14 of the blower nozzle 11, in respect to the normal surface line 16 of the roller 01 at the impact point P, is approximately 45°. The blown air stream spreads on the surface 03 of the roller 01 substantially along a tangential line 17 at the impact point P and in a direction toward a mouth 18 of the suction nozzle 12. In correspondence with the circumferential shape of the roller 01, an edge of the mouth 18 of the suction nozzle 12 is curved in the shape of a segment of a circle, so that the distance between the mouth 18 of the suction nozzle 12 and the surface 03 of the roller 01 is substantially identical all over. In this case, a wall 19 of the suction nozzle 12 facing the cut web of material 02 is extended upward to such a degree that the tangent line 17 intersects the wall 19. Therefore, no straight path exists from the point P to the web of material 02 on which straight path the blown air stream could reach the web of material with being braked.

FIG. 4 shows a second preferred embodiment of the cleaning device previously described with reference to FIGS. 1 to 3, and in a plan view analogous to that of FIG. 3. In this second embodiment, the mouth 18 of the suction nozzle 12 covers an even larger area of the circumference of the roller 01 than in the first preferred embodiment represented in FIG. 3. The outlet opening from the blower nozzle 11 is located inside the suction nozzle 12. With this arrangement, the suction nozzle 12 is able to aspirate off even those portions of the blown air stream which spread, starting from the impact point P, in the rotating direction of the roller 01, i.e. to the right in FIG. 4.

While preferred embodiments of a cleaning device for a longitudinal cutting device, and a method for cleaning the cutting device in accordance with the present invention have been set forth fully and completely hereinabove, it will be apparent to one of skill in the art that various changes in, for example the overall size of the roller, the drive for the roller, the source of the compressed air and the like could be made without departing from the true spirit and scope of the present invention which is accordingly to be limited only by the following claims.

What is claimed is:

1. A longitudinal cutting device adapted to cut a web of material comprising:

a roller adapted to support a web of material to be cut, said roller having a roller surface and being rotatable about a longitudinal roller axis of rotation;

a blade cooperating with said roller for cutting the web of material;

a blower nozzle arranged in a run-out gap between said roller and the web of material supported on said roller, said blower nozzle having a blower nozzle width in a direction of said roller axis of rotation; and a suction nozzle in said run-out gap, said suction nozzle having a suction nozzle width in said direction of said roller axis of rotation, said suction nozzle width being at least twice said blower nozzle width.

2. The longitudinal cutting device of claim 1 further including a groove on said roller, said groove having a groove width, said blower nozzle width being between 0.2 and 2.0 times said groove width.

3. The longitudinal cutting device of claim 1 wherein said roller is rotatable in a first direction of travel of the web of material to be cut and said blower nozzle is oriented to generate a fluid stream on a surface of said roller extending opposite to said direction of roller rotation.

4. The longitudinal cutting device of claim 1 wherein said blower nozzle directs a fluid stream in a main blowing direction toward said roller surface, wherein said suction nozzle has a wall facing away from said blower nozzle, and further wherein a line tangent to said roller surface at a point of impact of said fluid stream blown in said main blowing direction on said roller surface intersects said suction nozzle wall.

5. The longitudinal cutting device of claim 1 further including a collection container adapted to collect web particles aspirated by said suction nozzle.

6. The longitudinal cutting device of claim 1 wherein said blower nozzle is adapted to produce an air stream.

7. A longitudinal cutting device adapted to cut a web of material comprising:

a roller adapted to support a web of material to be cut, said roller having a roller surface and being rotatable about a longitudinal roller axis of rotation;

a blade cooperating with said roller for cutting the web of material;

a blower nozzle arranged in a run-out gap between said roller and the web of material to be cut, said blower nozzle directing a fluid stream in a main blowing direction toward said roller surface;

a suction nozzle in said run-out gap and having a wall facing away from said blower nozzle; and a point of impact of said fluid stream blown in said main blowing direction on said roller surface, wherein a line tangent to said roller surface at said point of impact intersects said suction nozzle wall.

8. The longitudinal cutting device of claim 7 further including a groove on said roller, said groove having a groove width, and a blower nozzle width in a direction of said roller axis of rotation, said blower nozzle width being between 0.2 and 2.0 times said groove width.

9. The longitudinal cutting device of claim 7 wherein said roller is rotatable in a first direction of travel of the web of material to be cut and said blower nozzle is oriented to generate a fluid stream on a surface of said roller extending opposite to said direction of roller rotation.

10. The longitudinal cutting device of claim 7 further including a collection container adapted to collect web particles aspirated by said suction nozzle.

11. The longitudinal cutting device of claim 7 wherein said blower nozzle is adapted to produce an air stream.

12. A method for cleaning a longitudinal cutting device including:

providing a roller;

supporting a web of material to be cut on a surface of said roller;

providing a blower nozzle;

using said blower nozzle and directing a fluid stream in a main blowing direction against said roller surface at a point of impact in an area of said roller surface facing away from the web of material;

flowing said fluid stream over said roller surface in a direction opposite to a rotation direction of said roller;

providing a suction nozzle having a wall facing away from said blower nozzle; and arranging said blower nozzle wherein a line tangent to said surface of said roller at said point of impact of said fluid stream with said roller surface is intersecting said suction nozzle wall.

13. The method of claim 12 further including using said suction nozzle for aspirating said fluid stream off said roller surface before said fluid stream impinges the web.

14. The method of claim 13 further including removing entrained particles from said aspirated-off fluid stream.

* * * * *